US005741119A

United States Patent [19]

Heppenstall

[11] Patent Number: 5,741,119

[45] Date of Patent: Apr. 21, 1998

[54] ROOT ATTACHMENT FOR A TURBOMACHINE BLADE

[75] Inventor: Mark Heppenstall, Derby, England

[73] Assignee: Rolls-Royce plc, London, England

[21] Appl. No.: 815,454

[22] Filed: Mar. 11, 1997

[30] Foreign Application Priority Data

Apr. 2, 1996 [GB] United Kingdom ..... 9606963

[51] Int. Cl.[6] ..... F01D 5/30

[52] U.S. Cl. ..... 416/219 R; 416/219 A; 416/221; 416/241 R

[58] Field of Search ..... 416/219 R, 220 R, 416/204 A, 193 A, 248, 241

[56] References Cited

U.S. PATENT DOCUMENTS

| | | | |
|---|---|---|---|
| 3,045,968 | 7/1962 | Willis | 416/219 |
| 4,433,005 | 2/1984 | Manty et al. | 427/38 |
| 4,824,328 | 4/1989 | Pisz et al. | 416/219 R |
| 5,110,262 | 5/1992 | Evans | 416/219 R |
| 5,292,385 | 3/1994 | Kington | 148/404 |
| 5,474,421 | 12/1995 | Rossmann . | |

FOREIGN PATENT DOCUMENTS

| | | |
|---|---|---|
| 2 030 657 | 4/1980 | United Kingdom . |
| 2 171 150 | 8/1986 | United Kingdom . |
| 2 238 581 | 6/1991 | United Kingdom . |

*Primary Examiner*—Edward K. Look
*Assistant Examiner*—Richard Woo
*Attorney, Agent, or Firm*—Cushman Darby & Cushman, Intellectual Property Group of Pillsbury Madison & Sutro, LLP

[57] ABSTRACT

A root attachment for a rotor blade of a gas turbine engine comprises teeth on the root section of the rotor blade and teeth on the slot of the rotor. The teeth flank surfaces of the teeth on the root section of the rotor blade are arranged at a different angle to the teeth flank surfaces of the teeth on the slot of the rotor. As the load on the rotor blade increases the teeth deflect such that the area of contact between the teeth flank surfaces of the root section and the slot increases to a maximum at the fully loaded condition. The teeth flank surfaces are substantially planar. This enables rotor blade and slot teeth with different stiffnesses to be used for the rotor blades and rotor, for example titanium aluminide turbine blades and nickel base alloy turbine rotor.

14 Claims, 2 Drawing Sheets

ROOT ATTACHMENT FOR A TURBOMACHINE BLADE

The present invention relates to an improved root attachment for a turbomachine blade, and is particularly concerned with an improved root attachment for a gas turbine engine blade to a rotor structure.

It is well known in the art, that the aerofoil blades of a gas turbine engine, both in the compressor and in the turbines, are normally carried from a disc or drum or other similar rotor structure. The engagement between the blades and the supporting rotor is a crucial part of the design of any such rotor, because it must sustain the loads carried from the blade to the rotor without failure, and it must be overall as small as possible so as to reduce the size of the blade root and rotor rim to a minimum.

In the past, a variety of blade root attachments have been proposed and used. Normally these have been of the general type in which the blade root has one or more projections of one sort or another which engage with undercut surfaces of a corresponding groove in the rotor periphery. The grooves may extend axially from one face to another of the rotor, or alternatively may extend circumferentially of the rotor periphery. Two widely used types of blade root attachment are called "dovetail" and "firtree" blade root attachments after the approximate cross-section of the blade root required in each case. The loads are transferred through the contacting surfaces of the blade root and the rotor groove.

In conventional blade root attachments the blade root projections, or teeth, have planar surfaces and similarly the rotor groove has projections, or teeth, which have planar surfaces, in which the contacting surfaces are arranged at the same angle. The projections, or teeth, on the blade root and the undercut groove deflect under loads resulting in a change in the angles of the contacting surfaces relative to each other. If the blade root projections and rotor projections have different stiffnesses this arrangement concentrates the blade to rotor interface load at one side of the nominal contact region. The differences in stiffness between the blade root projections and the rotor projections may be as a result of the use of different materials for the rotor and the blades. Alternatively the difference in stiffness between the blade root projections and the rotor projections may be as a result of the geometry of the blade root projections and the rotor projections.

The present invention seeks to provide a root attachment for a blade and rotor which have different stiffnesses which overcomes this problem.

Accordingly the present invention provides a root attachment for a blade of a turbomachine, the attachment comprising a root on the blade which is arranged to engage within a shaped slot in the rotor, the root has a plurality of projections each one of which is arranged to engage against a corresponding projection in the slot, the projections on the root and slot have contacting surfaces to transfer load from the blade to the rotor, the contacting surface of each projection on the root is substantially planar, the contacting surface of each projection on the slot is substantially planar, at least one of the projections on the root and the corresponding projection on the slot are arranged such that the contacting surfaces of the projections are arranged with a predetermined difference in angles relative to a datum plane whereby in operation the difference in angles between the contacting surfaces of the projections relative to the datum plane reduces to increase the area of contact between the contacting surfaces.

Preferably the predetermined difference in angles relative to the datum plane is arranged in operation to increase the area of contact between the contacting surfaces such that there is a predetermined load distribution over the contacting surfaces.

Preferably the predetermined difference in angles relative to the datum plane is arranged in operation to increase the area of contact between the contacting surfaces to maximum area of contact.

Preferably the predetermined difference in angles relative to the datum plane is arranged in operation to increase the area of contact between the contacting surfaces such that the contacting surfaces are coplanar.

Preferably each projection on the root and the corresponding projection on the slot are arranged such that the contacting surfaces of the projections are arranged at with a predetermined difference in angles relative to the datum plane.

The root attachment may be a firtree root attachment or a dovetail root attachment.

The root attachment for the blade and the rotor may comprise different materials. The root attachment for the blade may comprise a titanium aluminide alloy and the rotor comprises a nickel base alloy. The root attachment for the blade may comprise a gamma titanium aluminide alloy. The root attachment for the blade may comprise a titanium alloy and the rotor may comprise a nickel base alloy or a steel.

The root attachment may be used for compressor blades and turbine blades of a gas turbine engine.

The present invention will be more fully described by way of example with reference to the accompanying drawings, in which.

Figure 1:
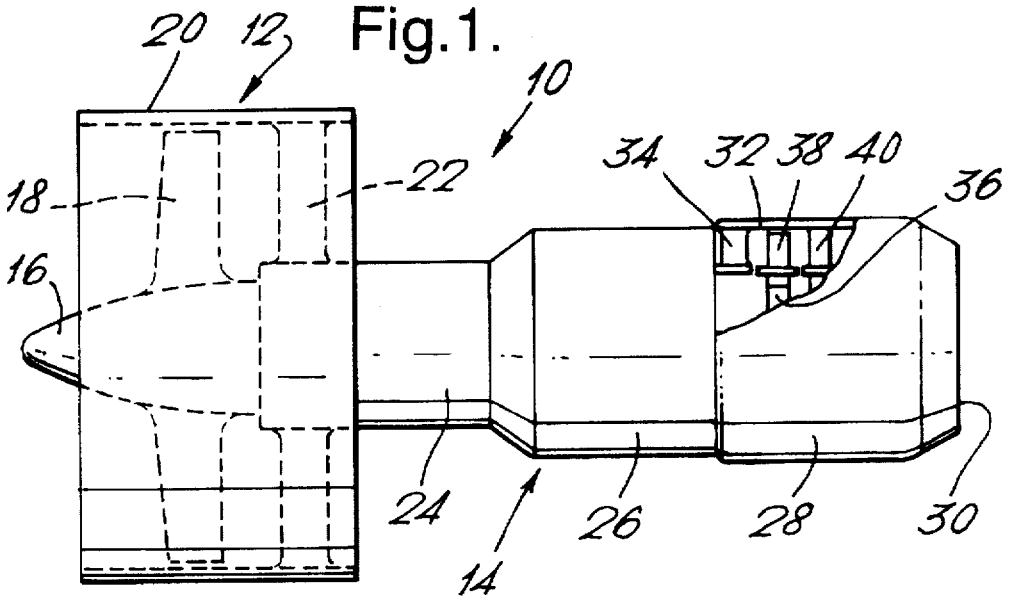
FIG. 1 is a partially cut away view through a gas turbine engine showing a root attachment for a blade according to the present invention.

A turbofan gas turbine engine 10, shown in FIG. 1, comprises a fan section 12 and a core engine 14. The fan section 12 comprises an inlet 16, a fan 18 arranged in a fan duct 20 and a fan duct exhaust 22. The core engine comprises in flow series a compressor section 24, a combustion section 26, a turbine section 28 and a core exhaust 30. The turbine section 28 is provided with a plurality of turbines to drive the fan 18 and compressor section 24 via shafts (not shown).

The gas turbine engine operates quite conventionally in that air is compressed as it flows through the fan section 12 and the compressor section 24 to the combustion section 26. Fuel is injected into the combustion section 26 and is burnt in the air to produce hot gases which flow through and drive the turbines in the turbine section 28. The turbines in the turbine section 28 drive the fan section 12 and the compressor section 24. The exhaust gases from the core engine 14 are discharged from the exhaust nozzle 30. The majority of the air flowing through the fan section 12 flows through the fan duct and is discharged from the fan duct exhaust 22.

The turbine section 28 comprises a turbine casing 32 which carries a plurality of axially spaced stages of turbine vanes 34, 40. Each stage of turbine vanes 34, comprises a plurality of circumferentially spaced radially extending turbine vanes. A turbine rotor 36 is arranged axially between the stages of turbine vanes 34, 40 and the turbine rotor 36 has a plurality of radially extending turbine blades 38.

Figure 2:
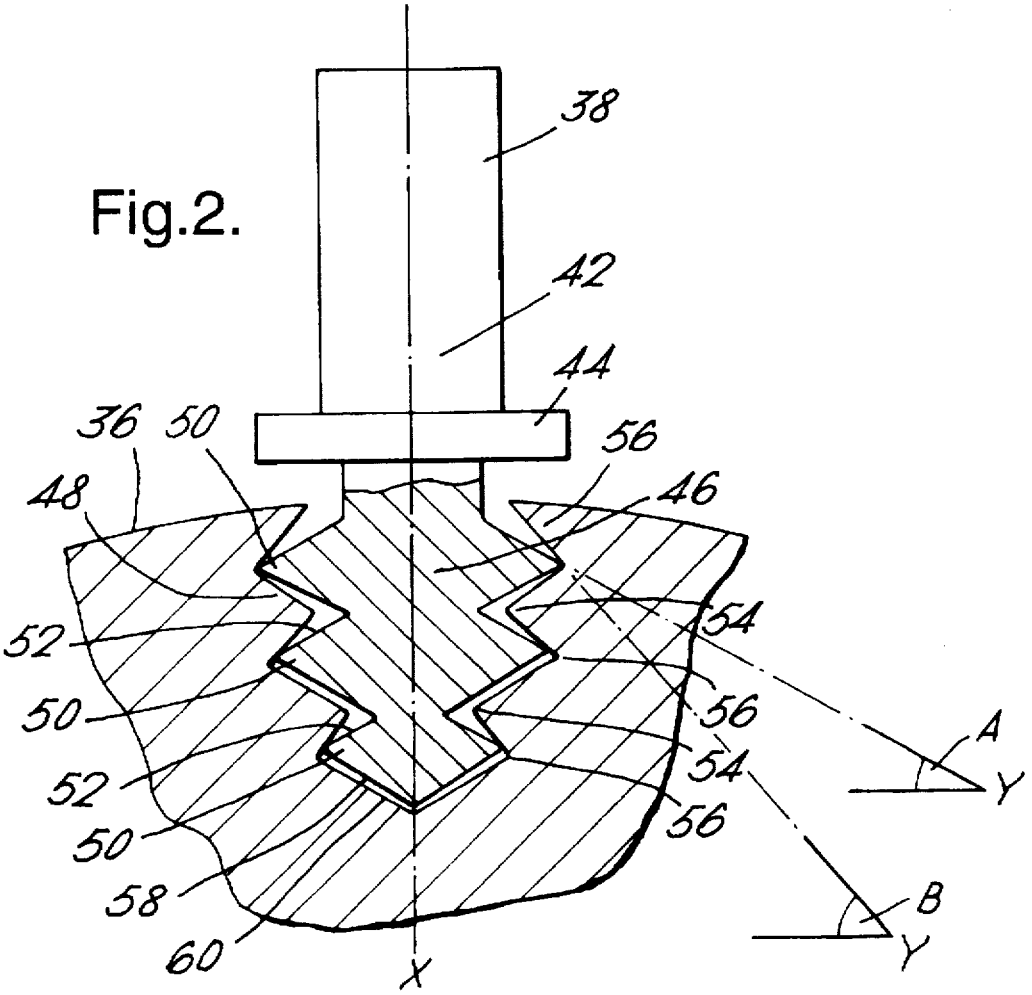
FIG. 2 is an enlarged cross-sectional view through a root attachment for a blade of a gas turbine engine according to the present invention.

Each turbine blade 38 comprises an aerofoil section 42, a platform section 44 and a root section 46 as is shown more clearly in FIG. 2, which is a cross-sectional in a plane perpendicular to the axis of the rotor. Each turbine blade 38 is secured to the turbine rotor 36 by means of its root section 46, which locates in a correspondingly shaped slot in the turbine rotor 36. The turbine rotor 36 is provided with a plurality of circumferentially spaced axially extending slots 48 which receive the root sections 46 of the turbine blades 38. The root sections 46 and slots 48 are "firtree" shape in cross-section.

Thus the root sections 46 have a plurality of teeth 50, six teeth in this example, which are arranged in two opposed plane arrays of three teeth 50 each symmetrically disposed about the central plane X of the turbine blade 38. The root sections 46 also have a plurality of notches 52. The notches 52 are arranged between adjacent pairs of teeth 50 in an array of teeth 50. The slots 48 of the turbine rotor 36 also have a plurality of teeth 54 and a plurality of notches 56. The notches 56 are arranged between adjacent teeth 54. The teeth 54 are equal in number to the number of notches 52 on the root section 46 and the notches 56 are equal in number to the teeth 50 on the root section 46. The teeth 50 on the root sections 46 locate in the notches 52 in the slots 48, similarly the teeth 54 on the slots 48 locate in the notches 56 in the root sections 46.

In conventional root attachments the angles of the root section teeth flank surfaces and the angles of the slot teeth flank angle surfaces are equal. A problem with this is that if the root section teeth and slot teeth have different stiffnesses, because for example they are made from different materials, the turbine blade to turbine rotor tooth interface load is concentrated at one side of the the nominal contact region. Thus the tooth interface load is not uniform over the whole of the nominal contact region.

In the present invention the flank surfaces 58 of the teeth 50 of the root sections 46 are arranged at a different angle to the flank surfaces 60 of the teeth 54 of the slots 48. The flank surfaces 58 and 60 are substantially planar except where they blend with the adjacent flank surfaces of the teeth. The flank surfaces 58 of the teeth 50 are arranged at an angle A relative to a datum line Y, which is perpendicular to the plane X, and the flank surfaces 60 of the teeth 54 are arranged at an angle B relative to the datum line Y. The angle B is greater than the angle A in this example. This difference in the angles of the flank surfaces 58 and 60 of the teeth 50 and 54 is designed to give a predetermined load distribution over the nominal contact region when the turbine blade 38 is in the fully loaded condition. Generally the angles A and B are arranged to give a uniform load per unit area over the whole of the nominal contact region. However, it may be possible to arrange the angles A and B to give other predetermined load distributions over the nominal contact region. This is because the teeth 50, 54 deflect when loaded. This design provides that as the load is increased the teeth 50, 54 deflect such that the area of contact between the flank surfaces 58 of the teeth 50 and the flank surfaces 60 of the teeth 54 gradually increases up to maximum contact area at the fully loaded condition.

It can be seen that the contacting flank surfaces 58, 60 of the teeth 50, 54 are arranged with a predetermined difference between the angles A and B relative to the datum plane X whereby in operation the difference in angles between the contacting flank surfaces 58, 60 of the teeth 50, 54 relative to the datum plane X reduces to increase the area of contact between the contacting flank surfaces 58, 60. The predetermined difference between the angles A and B relative to the datum plane X is arranged in operation to increase the area of contact between the contacting surfaces 58, 60 such that the contacting flank surfaces 58, 60 are coplanar.

This enables turbine blades and turbine rotors with different teeth stiffnesses to be used while maintaining a predetermined load distribution over the nominal contact region, for example the turbine blades and the turbine rotor may be made from different materials. For example the turbine blades may be made from gamma titanium aluminide and the turbine rotor may be made from nickel base alloy.

Figure 3:
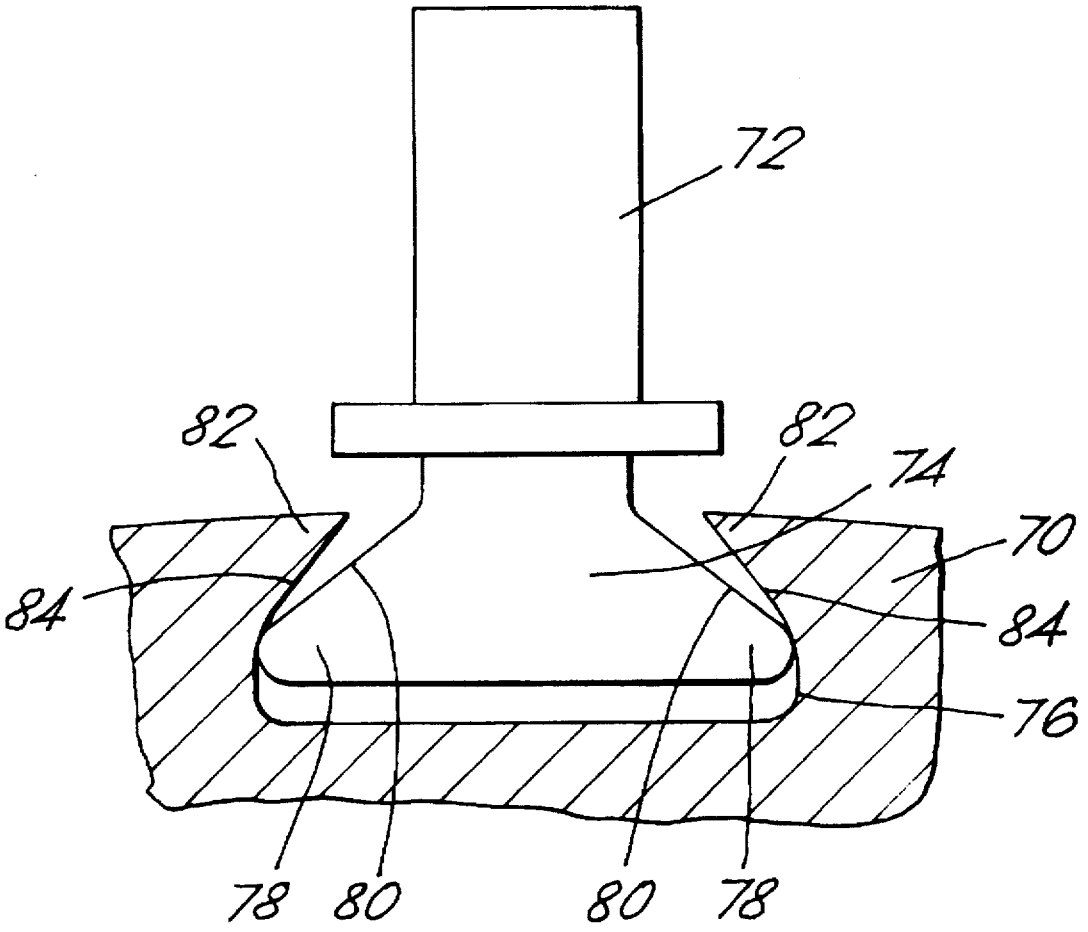
FIG. 3 is an enlarged cross-sectional view through an alternative root attachment for a blade of a gas turbine engine according to the present invention.

Another root attachment according to the present invention is shown in FIG. 3, which shows a rotor blade 72 and a rotor 70 which have root sections 74 and slots 76 which have "dovetail" shapes. The flank surfaces 80 of the two oppositely directed teeth 78 of the root section 74 of the rotor blade 72 are arranged at a different angle to the flank surfaces 84 of the teeth 82 of the slot 76 of the rotor 70. The dovetail shaped slot 76 may be either axially extending or circumferentially extending.

The invention is applicable to any type of turbomachine blade held to a rotor by a root attachment, for example compressor blades and turbine blades of gas turbine engines and also to steam turbines.

The invention is applicable to axially extending slots and also to circumferentially extending slots in the rotor.

The invention allows rotor blades and rotors with different teeth stiffnesses to be used in conjunction while retaining a predetermined load distribution over the nominal contact region, for example gamma titanium aluminide turbine blades and nickel base alloy turbine rotors, and titanium alloy compressor blades and nickel base alloy or steel compressor rotors.

I claim:

1. A root attachment for a blade of a turbomachine, the attachment comprising a root on the blade which is arranged to engage within a shaped slot in a rotor, the root has a plurality of projections each one of which is arranged to engage against a corresponding projection in the slot, the projections on the root and slot have contacting surfaces to transfer load from the blade to the rotor, the contacting surface of each projection on the root is substantially planar, the contacting surface of each projection on the slot is substantially planar, at least one of the projections on the root and the corresponding projection on the slot are arranged such that the contacting surfaces of the projections are arranged with a predetermined difference in angles relative to a datum plane whereby in operation the difference in angles between the contacting surfaces of the projections relative to the datum plane reduces to increase the area of contact between the contacting surfaces.

2. A root attachment as claimed in claim 1 in which the predetermined difference in angles relative to the datum plane is arranged in operation to increase the area of contact between the contacting surfaces such that there is a predetermined load distribution over the contacting surfaces.

3. A root attachment as claimed in claim 2 in which the predetermined difference in angles relative to the datum plane is arranged in operation to increase the area of contact between the contacting surfaces to maximum area of contact.

4. A root attachment as claimed in claim 2 in which the predetermined difference in angles relative to the datum plane is arranged in operation to increase the area of contact between the contacting surfaces such that the contacting surfaces are coplanar.

5. A root attachment as claimed in claim 1, 2, 3 or 4 in which each projection on the root and the corresponding projection on the slot are arranged such that the contacting surfaces of the projections are arranged at with a predetermined difference in angles relative to the datum plane.

6. A root attachment as claimed in claim 1 in which the root attachment is a firtree root attachment.

7. A root attachment as claimed in claim 1 in which the root attachment is a dovetail root attachment.

8. A root attachment as claimed in claim 1 in which the root attachment for the blade and the rotor comprise different materials.

9. A root attachment as claimed in claim 8 in which the root attachment for the blade comprises a titanium aluminide alloy and the rotor comprises a nickel base alloy.

10. A root attachment as claimed in claim 9 in which the root attachment for the blade comprises gamma titanium aluminide alloy.

11. A root attachment as claimed in claim 8 in which the root attachment for the blade comprises a titanium alloy and the rotor comprises a nickel base alloy.

12. A root attachment as claimed in claim 1 in which the root attachment is for a turbine blade of a gas turbine engine.

13. A root attachment as claimed in claim 1 in which the root attachment is for a compressor blade of a gas turbine engine.

14. A root attachment as claimed in claim 8 in which the root attachment for the blade comprises a titanium alloy and the rotor comprises a steel.

* * * * *